US009385418B2

(12) United States Patent
Kim et al.

(10) Patent No.: US 9,385,418 B2
(45) **Date of Patent: *Jul. 5, 2016**

(54) ANTENNA APPARATUS FOR PORTABLE TERMINAL

(71) Applicant: Samsung Electronics Co., Ltd., Gyeonggi-do (KR)

(72) Inventors: Jae-Hee Kim, Gyeonggi-do (KR); Joon-Ho Byun, Gyeonggi-do (KR); Se-Hyun Park, Gyeonggi-do (KR); Dong-Hyun Lee, Gyeonggi-do (KR); Austin Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/719,642

(22) Filed: May 22, 2015

(65) Prior Publication Data

US 2015/0255857 A1 Sep. 10, 2015

Related U.S. Application Data

(63) Continuation of application No. 14/461,527, filed on Aug. 18, 2014, now Pat. No. 9,059,506, which is a continuation of application No. 13/440,235, filed on Apr. 5, 2012, now Pat. No. 8,842,048.

(30) Foreign Application Priority Data

Apr. 14, 2011 (KR) ..... 10-2011-0034548

(51) Int. Cl.
*H01Q 1/24* (2006.01)
*H01Q 1/44* (2006.01)

(Continued)

(52) U.S. Cl.
CPC ..... *H01Q 1/243* (2013.01); *H01Q 1/44* (2013.01); *H01Q 21/28* (2013.01); *H01Q 21/29* (2013.01)

(58) Field of Classification Search
CPC ..... H01Q 1/243; H01Q 21/28
USPC ..... 343/702, 700 MS, 846, 848
See application file for complete search history.

(56) References Cited

U.S. PATENT DOCUMENTS

| | | | |
|---|---|---|---|
| 5,048,118 | A | 9/1991 | Brooks et al. |
| 8,270,914 | B2 | 9/2012 | Pascolini et al. |
| 8,842,048 | B2 | 9/2014 | Kim et al. |

(Continued)

FOREIGN PATENT DOCUMENTS

| | | | |
|---|---|---|---|
| CN | 101814649 | A | 8/2010 |
| CN | 202353552 | U | 7/2012 |

(Continued)

*Primary Examiner* — Hoanganh Le
(74) *Attorney, Agent, or Firm* — Cha & Reiter, LLC

(57) ABSTRACT

An antenna apparatus for a portable terminal having a main board is provided. The antenna apparatus includes a main antenna that electrically connects to a feed line of the main board. A metal frame is constructed as part of a case frame forming an exterior of the portable terminal. The metal frame is divided into first and second parts that are separated. The first part electrically connects to the main antenna or to the main board feed line, and is designed to radiate. The second part electrically connects to a ground surface of the main board. The metal frame enhances overall antenna performance rather than causing degradation through interference.

18 Claims, 4 Drawing Sheets

(51) Int. Cl.
*H01Q 21/28* (2006.01)
*H01Q 21/29* (2006.01)

(56) References Cited

U.S. PATENT DOCUMENTS

| | | | | |
|---|---|---|---|---|
| 9,059,506 | B2 * | 6/2015 | Kim | H01Q 1/243 |
| 2004/0257283 | A1 | 12/2004 | Asano et al. | |
| 2010/0090921 | A1 | 4/2010 | Kim et al. | |
| 2010/0123632 | A1 | 5/2010 | Hill et al. | |
| 2012/0112969 | A1 | 5/2012 | Caballero et al. | |
| 2012/0112970 | A1 | 5/2012 | Caballero et al. | |
| 2012/0157175 | A1 | 6/2012 | Golko et al. | |
| 2012/0206302 | A1 | 8/2012 | Ramachandran et al. | |
| 2012/0229347 | A1 | 9/2012 | Jin et al. | |

FOREIGN PATENT DOCUMENTS

| | | | |
|---|---|---|---|
| EP | 2 109 185 | A1 | 10/2009 |
| EP | 2 290 742 | A1 | 3/2011 |
| KR | 10-2010-0032681 | A | 3/2010 |
| KR | 10-2011-0002731 | A | 1/2011 |
| KR | 10-2011-0008606 | A | 1/2011 |

* cited by examiner

ANTENNA APPARATUS FOR PORTABLE TERMINAL

CROSS REFERENCE TO RELATED APPLICATIONS

This application is a Continuation of U.S. patent application Ser. No. 14/461,527 filed on Aug. 18, 2014 which claims the benefit of the earlier U.S. patent application Ser. No. 13/440,235 filed on Apr. 5, 2012 and assigned U.S. Pat. No. 8,842,048 issued on Sep. 23, 2014 which claims priority under 35 U.S.C. §119(a) to an application filed in the Korean Intellectual Property Office on Apr. 14, 2011 and assigned Serial No. 10-2011-0034548, the contents of which are herein incorporated by reference.

BACKGROUND

1. Technical Field

The present disclosure relates to an antenna apparatus in a portable terminal.

2. Description of the Related Art

At present, owing to the rapid advances in telecommunications, portable terminals such as cell phones, smart phones, PDAs, tablet and laptop PCs, and the like, are becoming a necessity to modern society.

In recent years, the functionality of ordinary portable terminals has expanded, while the size and weight have been kept to a minimum. Slim, generally rectangular devices without protruding antennas have been popularized. In these devices, an internal antenna for voice communication, Internet access, etc. is deployed. However, expanded functionality has required more electronic components, such that internal space is restricted. Thus a design challenge for these devices is to find suitable space to package the added components, including the internal antenna(s), while maintaining the device slim, lightweight and small.

In the case of the antenna, its design and placement with respect to other components must be sufficient to achieve required performance metrics. In general, a design challenge is to package an antenna of adequate length to meet requirements in today's small devices. Further, recently a metal body provided for aesthetics has been constructed as part of a case frame forming an outward appearance of the terminal. This metal body causes reflections of RF power and thereby is the cause of deteriorating performance of the antenna.

SUMMARY

An aspect of the present invention is to substantially solve at least the above problems and/or disadvantages and to provide at least the advantages below. Accordingly, one aspect of the present invention is to provide an antenna apparatus for a portable terminal for preventing a metal body, which is provided for aesthetics and constructed as part of a case frame, from deteriorating antenna performance.

Another aspect of the present invention is to provide an antenna apparatus for a portable terminal for enhancing antenna performance by using a metal body of a case frame as an antenna radiator.

According to one aspect of the present invention, an antenna apparatus for a portable terminal having a main board is provided. The antenna apparatus includes a main antenna that electrically connects to a feed line of the main board. A metal frame is constructed as part of a case frame forming an exterior of the portable terminal. The metal frame is divided into first and second parts that are separated. The first part electrically connects to the main antenna or to the main board feed line and is designed to radiate. The second part electrically connects with a ground surface of the main board.

In various embodiments of the present invention, the metal frame bolsters antenna performance instead of degrading performance of the built-in antenna, by acting as an additional radiating element, improving matching of the built-in antenna, radiating in an additional frequency band, and/or reducing noise

BRIEF DESCRIPTION OF THE DRAWINGS

The above features and advantages of the present invention will become more apparent from the following detailed description when taken in conjunction with the accompanying drawings in which.

DETAILED DESCRIPTION

Hereinafter, exemplary embodiments of the present invention will be described herein below with reference to the accompanying drawings. For the purposes of clarity and simplicity, well-known functions or constructions are not described in detail since they would obscure the invention in unnecessary detail. And, terms described below, which are defined considering functions in the present invention, can be different depending on user and operator's intention or practice. Therefore, the terms should be defined on the basis of the disclosure throughout this specification.

Briefly, the present invention relates to an antenna apparatus for a portable terminal in which a metal frame constructed as part of a case frame is realized as an antenna element that serves to enhance antenna performance rather than deteriorate performance of the internal antenna. The metal frame may have the additional purpose of enhancing aesthetics of the portable terminal.

Also, the present invention relates to an electronic device including an antenna apparatus in which a metal frame constructed as part of a case frame is realized as an antenna element that serves to enhance antenna performance rather than deteriorate performance of the internal antenna. The electronic device may be a portable communication terminal or a portable terminal.

Figure 1:
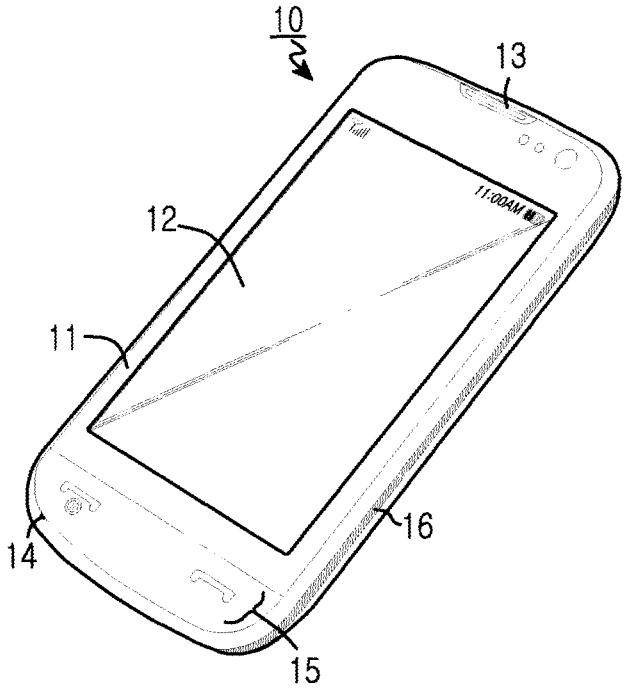
FIG. 1 is a perspective view illustrating a portable terminal according to an exemplary embodiment of the present invention.

FIG. 1 is a perspective view illustrating a portable terminal 10 according to an exemplary embodiment. The portable terminal may be one example of the electronic device. Also, the portable terminal may be a portable communication terminal. The portable terminal 10 includes a case frame 11 defining an outer surface, and the following constituent elements provided within the case frame 11: a display 12 for displaying images and video; a speaker 13 for outputting sound; a microphone 14 for inputting an audio signal; and a key button 15 or a touch key for user input. The display 12 can be a Liquid Crystal Display (LCD), a Plasma Display Panel (PDP) and the like and, in addition, can be a touch screen applying a touch sensor. The touch screen displays data received via an antenna. Electronic components associated with the foregoing elements, as well as other processing, control and RF communication electronics, may be mounted on a main printed circuit board of the portable terminal to be described.

The case frame 11 includes a metal frame 16 that may be provided to enhance the aesthetics of portable terminal 10 and/or for rigidity. The metal frame 16 surrounds the main printed circuit board (motherboard). In conventional portable terminals, a metal frame of this type causes electromagnetic interaction with the main board and internal antenna. As a result, conventional metal frames degrade the performance of a built-in antenna due to interference. As described in detail below, a proposed construction of the present invention for solving this problem is given as follows. The metal frame 16 is separated into at least two parts. A first part of the metal frame 16 is a sub antenna, and assists the radiation of a main antenna by both radiating itself and improving matching of the main antenna. A second part of the metal frame 16 can be a grounded body which removes noise.

Figure 2A:
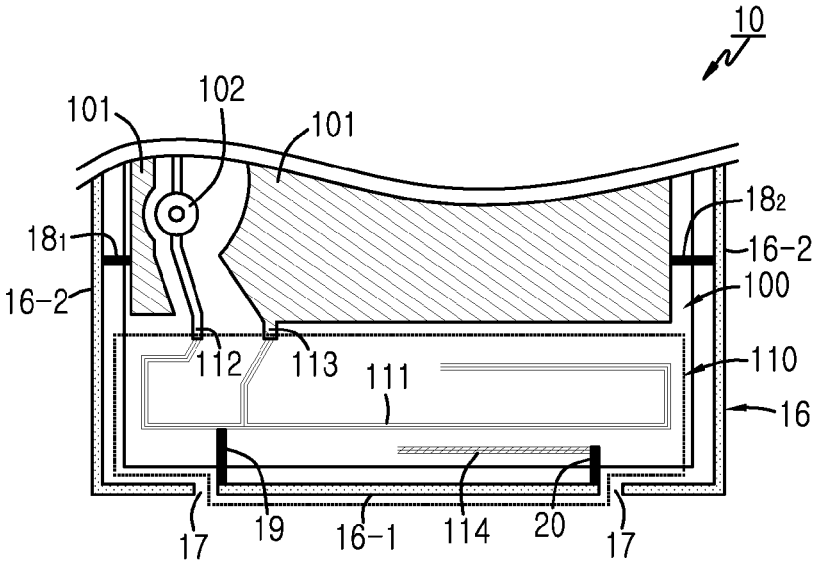
FIG. 2A is a plan view of illustrating a construction of an antenna apparatus according to an exemplary embodiment of the present invention, assembled within the portable terminal.

FIG. 2A is a plan view of an example construction of an antenna apparatus, 110, within portable terminal 10 according to an exemplary embodiment of the present invention. The antenna apparatus 110 transmits/receives signals from/to terminal 10 over an operational frequency band or bands. Portable terminal 10 includes a main printed circuit board 100 (e.g., the terminal 10's motherboard) that includes an RF communication unit (not shown) with transceiver interfacing with antenna apparatus 110. Main board 100 includes a feed line 112 electrically connecting the RF communication unit and antenna apparatus 100, and further includes a ground surface 101 to which antenna apparatus 110 is grounded.

The antenna apparatus 110 includes a main antenna 111, and at least one sub antenna capable of assisting the radiation of the main antenna 111 and/or transmitting/receiving a signal of a different frequency band than the main antenna 111. The main antenna 111 can be of a type attached to a carrier disposed within the terminal and fixed to the main board 100, a type attached directly to the main board 100, or the like. In alternative implementations, main antenna 111 can be of an exterior type protruding to the exterior of the terminal 10. The main antenna 111 may be protruded to the exterior of the terminal 10.

Particularly, the sub antenna can be the metal frame 16 of the case frame, which is also provided to enhance the aesthetics of terminal 10. As aforementioned, the metal frame 16 is separated into at least two parts. A first part 16-1 of the metal frame 16 is a sub antenna capable of electrically connecting by a connection means 19 with the main antenna 111 and radiating together with the main antenna 111. That is, the first part 16-1 receives a surface current from the main antenna 111 and radiates. The connection means 19 can be any suitable means such as a mechanically pressured, spring loaded, soldered, or the like electrical connection. (The same applies for connection means 18 and 20 discussed below.)

The first part 16-1 of the metal frame 16 advantageously enhances antenna performance by acting as an additional radiating element at the operating frequency band, thereby increasing the overall effective antenna size. And this is beneficially achieved without requiring any additional space within the portable terminal 10.

It is noted here that in an alternative design, instead of electrically connecting directly to the main antenna 111 as described, the first part 16-1 can connect directly to feed line 112 and still radiate in a desired manner.

Figure 2B:
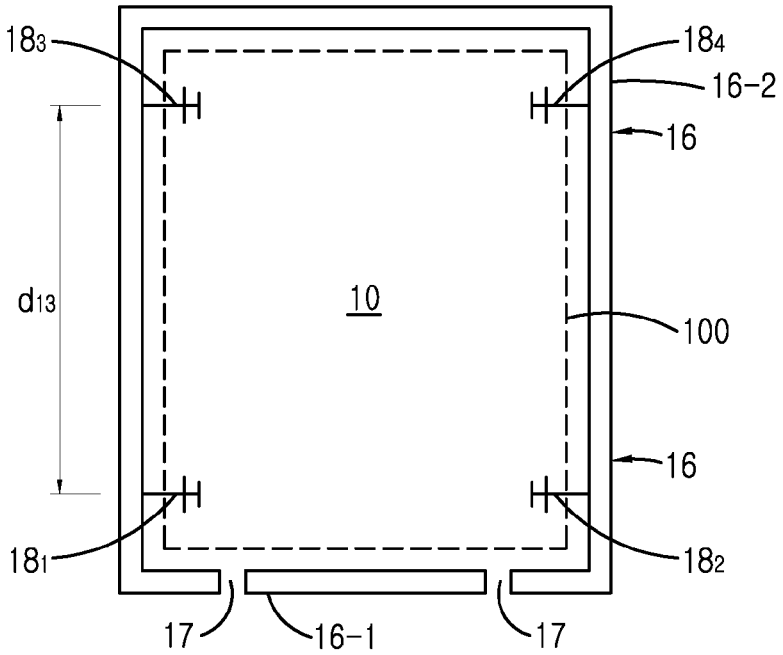
FIG. 2B illustrates an exemplary metal frame of the portable terminal.

The second part 16-2 which is separated from the first part 16-1 in the metal frame 16, electrically connects at one or more predetermined locations by a at least one connection means such as $\mathbf{18}_1$ to a ground surface 101 of the main board 100, serving as a ground body. That is, the second part 16-2 serves as an additional ground body of the antenna apparatus according to the exemplary embodiment of the present invention. As depicted in FIG. 2B, the second part 16-2 can extend around the entire body of the portable terminal 10 as one U-shaped piece. That is, the second part 16-2 can be configured in a U-shape to run continuously along the periphery of portable terminal 10, extending along the entirety of two lengthwise sides and at least one width-wise side of the generally rectangular portable terminal 10. In this example, four connection means $\mathbf{18}_1$, $\mathbf{18}_2$, $\mathbf{18}_3$ and $\mathbf{18}_4$ are each used to ground second part 16-2 to the ground surface of main body 100 at a respective predetermined point.

The second part 16-2 of the metal frame 16 may prevent noise resulting from electromagnetic interaction between itself and the main board 100. When metal frames in conventional portable terminals are not constructed as a ground body, antenna performance may be deteriorated by electromagnetic interaction with the main board or the main antenna of the portable terminal. Embodiments of the present invention, by contrast, alleviate this problem by dividing the metal frame into two separate parts and grounding the second part 16-2.

Although the second part 16-2 electrically connects with the ground surface 101 of the main board 100 at one or more points, the second part 16-2 can be designed to resonate within an operating frequency band of portable terminal 10 due to a ground current and the like. Second part 16-2 can also be designed not to resonate. Further, the second part 16-2 may be magnetically coupled with the main antenna 111 and the first part 16-1, via placement of suitable magnetic material at strategic locations between second part 16-2 and main antenna 111 or first part 16-1.

One way for the second part 16-2 not to resonate (and hence, not to radiate), is to have a length of less than ¼ wavelength at a resonant frequency of the main antenna 111 or the first part 16-1. Depending on the operating frequency bands of portable terminal 10, the entire U-shaped length of second part 16-2 may be longer than ¼ wavelength at the operating band; thus, the second part 16-2 can be designed to be discontinuous at one or more points along the periphery such that the total length will be less than ¼ wavelength.

Another way to prevent the second part 16-2 from radiating, even where the second part 16-2 has a length of greater than ¼ wavelength of the resonant frequency of the main antenna 111 or the first part 16-1, is to provide a plurality of connection means 18*i* arranged at an interval of less than ¼ wavelength of the resonant frequency. Thus in the example of FIG. 2B, it is assumed that the total U-shaped length exceeds ¼ wavelength; however, four connection means $\mathbf{18}_1$, $\mathbf{18}_2$, $\mathbf{18}_3$ and $\mathbf{18}_4$ are employed with a distance $d_{13}$ between adjacent connection means along the periphery. With this distance $d_{13}$ set less than ¼ wavelength, radiation by the second part 16-2 is prevented.

Referring still to FIG. 2A, for wireless communication, the main board 100 can include elements such as a Radio Frequency (RF) connector 102, the ground surface 101, a chip, a circuit pattern and the like. The main board 100 includes feed line 112 electrically connecting with the RF connector 102, and a ground point 113 electrically connecting with the ground surface 101. In FIG. 2A, ground surface 101 is shown in a cut-away view in order to show an example configuration of connector 102 and feed line 112. Feed line 112 can be, e.g., a conducting strip of a microstrip transmission line, with the ground surface 100 being the ground surface of the microstrip. The main antenna 111 electrically connects with the feed line 112 and the ground point 113 in the example embodiment. That is, a stub line of a predetermined length, extends from main antenna 111 at a predefined location to connect to ground point 113. However, in other implementations, the connection of main antenna 111 to ground point 113 can be eliminated.

Main antenna 111 can includes a feeding pin and a ground pin corresponding to the feed line 112 and the ground point 113 to make suitable electrical connection. The main antenna 111 receives a feed of a current through the feed line 112. Also, the main antenna 111 electrically connects with the ground surface 101 through the ground point 113.

In addition, the antenna apparatus may further include a second sub antenna 114, which is electrically connected by a predetermined means 20 to the first part 16-1 of the metal frame 16. The second sub antenna 114 may assist the radiation of the main antenna 111 or transmit/receive a signal of a different frequency band with the main antenna 111. As illustrated, the second sub antenna 114 may be constructed within the terminal 10.

The main antenna 111, without the electrical connection to first part 16-1, may be mismatched at a desired resonant frequency within the operating band of terminal 10. By connecting to first part 16-1 acting as a first sub-antenna, and also to second sub-antenna 114 of suitable design through the first sub-antenna 116-1, the mismatch can be compensated for, to reduce or effectively eliminate the mismatch. Also, the sub antennas 16-1 and 114 may transmit/receive a signal at a different frequency band, than the main antenna 111. As one example, the main antenna 111 may transmit/receive a signal at a call band, and the sub antennas 16-1 and 114 may transmit/receive a signal at a frequency band of Bluetooth, WiFi, DMB, GPS and the like. (This aspect of antenna apparatus 110 is analogous to the characteristics of a log periodic antenna, where different portions of the antenna are designated to radiate/receive at different frequencies.)

Figure 3:
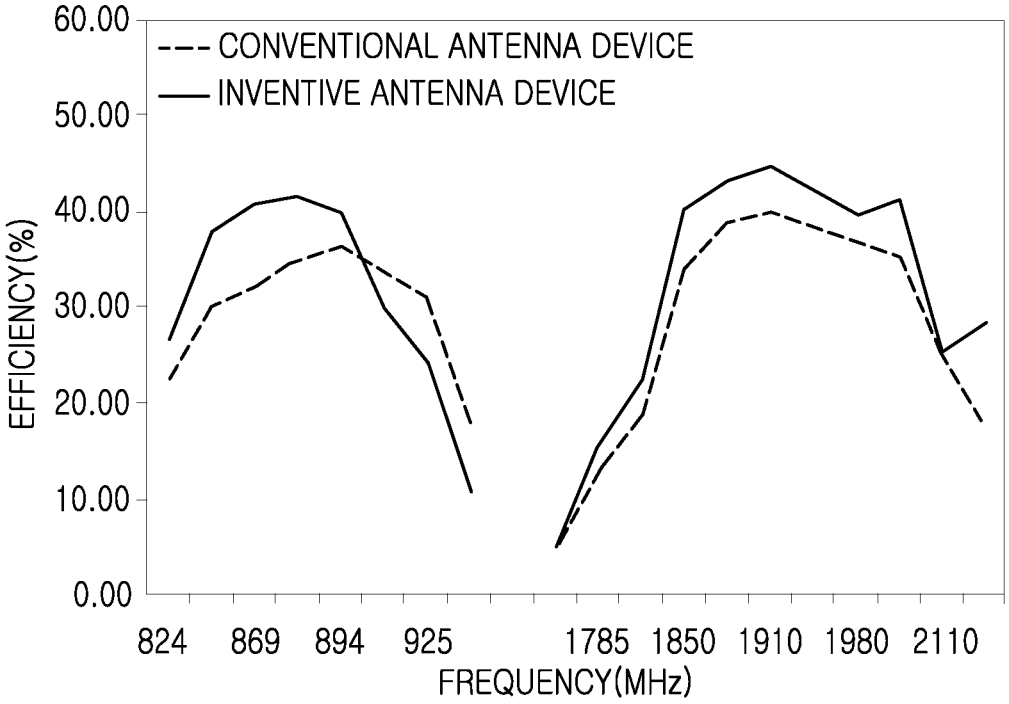
FIG. 3 is a graph showing an antenna performance comparison between the conventional antenna apparatus including no metal frame as an antenna and an antenna apparatus including a metal frame as an antenna according to the present invention.

FIG. 3 is a graph showing an antenna performance comparison between the conventional antenna apparatus including no metal frame as an antenna and an antenna apparatus further including a metal frame as an example antenna according to the present invention.

As shown in FIG. 3, the example antenna apparatus of the present invention has improved antenna performance at a corresponding frequency band (e.g., Code Division Multiple Access (CDMA), Personal Communication Service (PCS)) compared to the conventional art. In other words, it is considered that the conventional antenna apparatus does not work well because a main antenna is interfered with by a metal frame. As seen in the performance comparison curves, the example antenna of the present invention exhibits superior efficiency in two operating frequency bands of the portable terminal.

It is noted here, that an antenna apparatus according to the exemplary embodiment of the present invention may correct a mismatching resonant frequency of the antennas 111, 16-1, and/or 114 by further including an antenna matching device or matching circuit in the main board 100.

One method for guaranteeing the performance of a main antenna is removing a metal frame but, as described above, it may be appreciated that the construction of the antenna apparatus according to the exemplary embodiment of the present invention is effective in improving the antenna performance when a metal frame is constructed at a case frame to make an outward appearance aesthetically pleasing. Further, the present invention may be applied to, in addition to the metal frame 16, the equivalent thereof, i.e., a metal body that is constructed at the case frame without regard to aesthetics and deteriorates the performance of the main antenna 111. However, the present invention recognizes that a one-piece type metal frame can easily interfere with the main antenna 111 by means of electromagnetic interaction with the main board 100 because of its form. Therefore, as aforementioned, the metal frame 16 according to the exemplary embodiment of the present invention is separated into at least two parts, and the separated parts are realized as a sub antenna and a ground body, respectively. In alternative implementations, only one of the separated parts may be connected (e.g., only part 16-1 or part 16-2 can be designed to connect to main antenna 111 and ground surface 101, respectively, while the other part is "floating").

Generally, the main antenna 111 is situated at a top or bottom portion of the terminal 10. The reason is, when a user holds the terminal in his/her hand, both sides of the terminal typically make contact with the user's hand. Thus by locating the main antenna 111 at the top or bottom of the terminal, results in less interference by the user's hand contacting both sides of the terminal Considering this, it is desirable that the sub antenna is situated at the bottom or top of the terminal, and this embodiment is shown in FIGS. 2A and 2B.

Further, if a user holds a conventional terminal in his/her hand, a metal frame typically makes contact with the user's hand. This causes a further degradation in antenna performance. Even in the antenna apparatus according to the exemplary embodiment of the present invention, in the same manner, if a hand reaches the metal frame 16 that is conducting a current, improved antenna performance cannot be guaranteed. Specifically, if the hand reaches the first part 16-1 of the metal frame 16, it cannot guarantee the improved antenna performance. A construction for solving this is described below with reference to FIG. 4.

Figure 4:
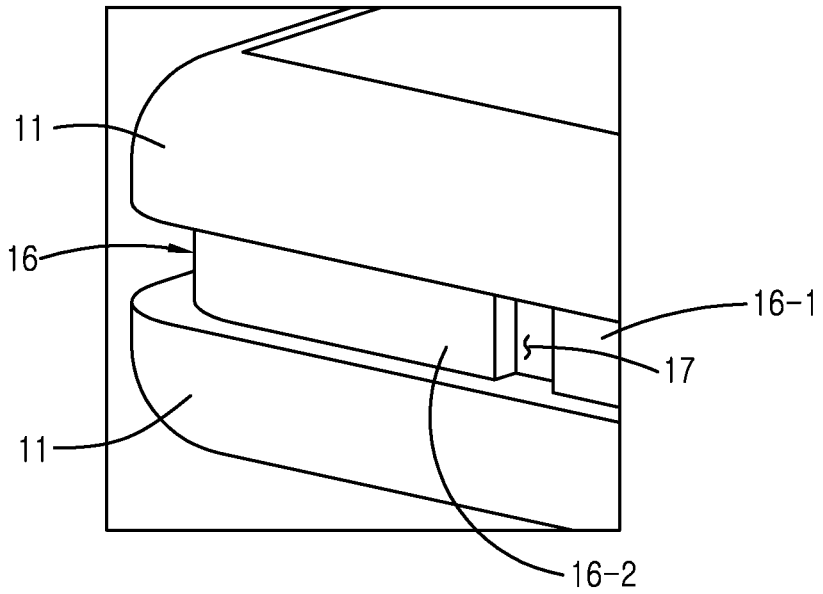
FIG. 4 is a diagram illustrating a construction of a case frame including a metal frame that acts as antenna element according to an exemplary embodiment of the present invention.

FIG. 4 is a diagram illustrating a case frame at which a metal frame is constructed according to an exemplary embodiment of the present invention. As shown, metal frame 16 is recessed from a case frame 11, to prevent the user's hand from contacting the first part 16-1. Frame 16 has at least two cutaway parts 17 (also shown in FIG. 2A), and is separated into at least two or more parts 16-1 and 16-2. Also, the metal frame 16 is exposed to the exterior and is constructed recessed from an outer surface of the case frame 11. Therefore, when a user holds a terminal in his/her hand, the hand does not reach the metal frame 16, so it can guarantee improved antenna performance. As aforementioned, specifically, the first part 16-1 of the metal frame 16 does not come in contact with the user's hand and therefore, improved antenna performance can be achieved.

As described above, an antenna apparatus according to the present invention can realize a metal frame, which is constructed as part of a case frame providing an aesthetically pleasing outward appearance, as an element capable of enhancing antenna performance.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An apparatus comprising:

a radiating element; and a conductive member forming at least one portion of a periphery of the apparatus, the conductive member including a first portion and a second portion separated from the first portion, the first portion to be electrically coupled with the radiating element, and the second portion to be electrically decoupled with the radiating element.

2. The apparatus of claim 1, wherein the first portion is coupled with the radiating element via a connector.

3. The apparatus of claim 1, wherein the first portion includes another radiating element, and wherein the radiating element and the other radiating element form at least one antenna.

4. The apparatus of claim 3, wherein the radiating element is to support a first specified frequency band, and the other radiating element is to support a second specified frequency band.

5. The apparatus of claim 3, wherein the other radiating element is to support a specified frequency band in coordination with the radiating element.

6. The apparatus of claim 3, further comprising a third radiating element coupled with the first portion.

7. The apparatus of claim 6, wherein the third radiating element is coupled with the first portion via a connector.

8. The apparatus of claim 1, wherein the second portion forms at least one portion of a ground with respect to the radiating element.

9. The apparatus of claim 1, further comprising a ground plane formed in an interior of the apparatus, wherein the second portion is coupled with the ground plane.

10. The apparatus of claim 9, wherein the second portion is coupled with the ground plane via a plurality of connectors including a first connector and a second connector, the first and second connectors apart from each other by a specified distance.

11. The apparatus of claim 1, wherein the conductive member comprises a gap located between the first portion and the second portion.

12. The apparatus of claim 11, wherein the gap is composed of a non-conductive material.

13. The apparatus of claim 1, wherein the first portion or the second portion is composed of a metal material.

14. The apparatus of claim 1, wherein the first portion is formed in a first direction of the periphery, and at least one portion of the second portion is formed in a second direction of the periphery.

15. An apparatus comprising:

a frame forming an outer surface of the apparatus;

a radiating element; and a conductive member adjacent to the frame and forming at least one portion of a periphery of the apparatus, the conductive member including a first portion and a second portion separated from the first portion, the first portion to be electrically coupled with the radiating element, and the second portion to be electrically decoupled with the radiating element.

16. The apparatus of claim 15, wherein at least one portion of the first portion or the second portion is recessed from the frame.

17. An apparatus comprising:

an antenna; and a conductive member forming at least one portion of a periphery of the apparatus, the conductive member including a first portion and a second portion separated from the first portion, the first portion to be electrically coupled with the antenna, and the second portion to be electrically decoupled with the antenna.

18. The apparatus of claim 17, further comprising a feed line coupled with the antenna.

* * * * *